United States Patent [19]

French

[11] Patent Number: 4,804,123

[45] Date of Patent: Feb. 14, 1989

[54] UPRIGHT CANOE CARRIER

[76] Inventor: Timothy S. French, 6818-108 Winding Cedar Trail, Charlotte, N.C. 28212

[21] Appl. No.: 826,811

[22] Filed: Feb. 6, 1986

[51] Int. Cl.[4] ..... A45F 3/00

[52] U.S. Cl. ..... 224/266; 294/15; 114/343; 114/347; 224/272

[58] Field of Search ..... 114/343, 347; 224/201, 224/210, 265, 266, 191, 270, 272; 441/136; 294/15–17

[56] References Cited

U.S. PATENT DOCUMENTS

| | | | |
|---|---|---|---|
| 3,377,095 | 4/1968 | Allen | 294/15 |
| 3,436,778 | 4/1969 | Stevens et al. | 294/15 X |
| 3,734,367 | 5/1973 | Jackson | 224/262 |
| 4,016,615 | 4/1977 | Main | 114/343 |
| 4,236,267 | 12/1980 | Lewis et al. | 114/347 |
| 4,641,874 | 2/1987 | Grenzer | 294/15 |

*Primary Examiner*—Henry J. Recla
*Assistant Examiner*—Ernest G. Cusick

[57] ABSTRACT

This invention consists of a protaging kit which provides a device for carrying a canoe in an upright position, whereby, making it possible to carry some cargo in the canoe during portages. The kit consists of two identical handles which are secured to the tips of the bow and stern of the canoe to provide a lifting point for persons portaging the canoe.

1 Claim, 2 Drawing Sheets

UPRIGHT CANOE CARRIER

BACKGROUND OF THE INVENTION

1. Field of the Invention

This invention relates to a canoe accessory which is attachable to a canoe to facilitate the portage of a canoe. The device is a collaspable handle or yoke-like member which can be stored in a canoe taking up a small space in the canoe when not in use.

2. Description of the Prior Art

Previously, the most common way for the portage of canoes has been turning the canoe upside down and carrying it over the heads of persons carrying it. This has been achieved with and without specially designed portage devices. These have the disadvantages of not allowing cargo to remain in the canoe while being carried because in the inverted or upside down position cargo would readily fallout.

SUMMARY OF THE INVENTION

The present invention is summarized in that a yoke-like member is attached at each end of a canoe when the canoe is in its upright position. This allows for the portage of the canoe with its cargo remaining in the canoe.

This is accomplished by providing a yoke-like member having two parallel rod-like elements connected at one end to a cross bar. The parallel elements rest of carrier's shoulders. The cross bar is connected at its approximate midpoint to an elongated single bar element which in turn is connected at the approximate midpoint of a final bar element. The entire yoke-like member is connected by a connecting rope or the like to a canoe. The rope acts as a fulcrum or pivot point for the portage of the canoe when an upwind force is exerted by the carriers on the yoke-like member.

DESCRIPTION OF THE PREFERRED EMBODIMENT

Figure 1:
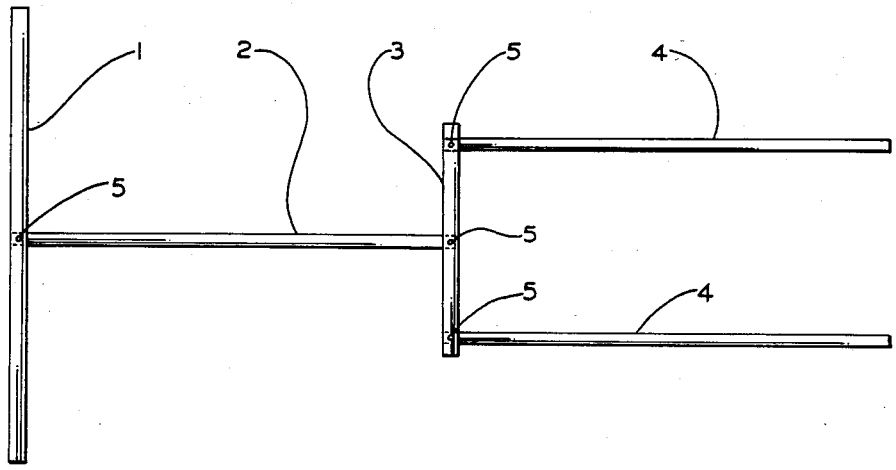
FIG. 1 is a top view of one of the yoke-like members or handles.
Figure 3:
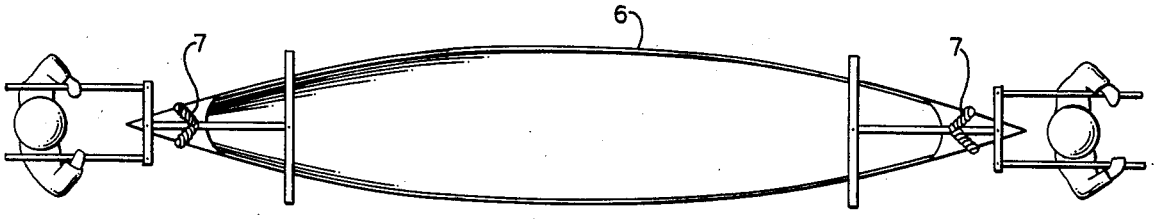
FIG. 3 is a top view of a canoe being carried by two individuals by the yoke-like members or handles.
Figure 4:
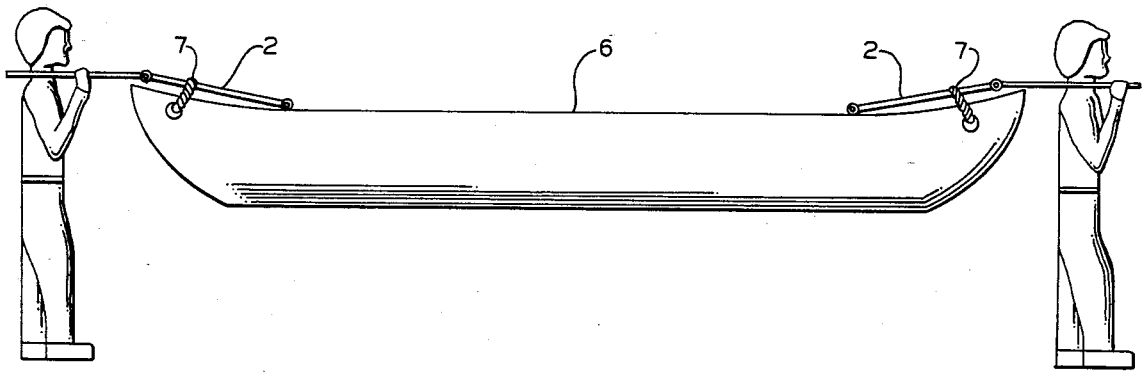
FIG. 4 is a side view of FIG. 3.

The present invention comprises two handle or yoke-like member, as shown in FIG. 1, attached to ends of the canoe to carry the canoe, as seen in FIGS. 3 and 4. By carrying the canoe in an upright orientation, cargo may remain in the canoe during the portage.

Figure 2:
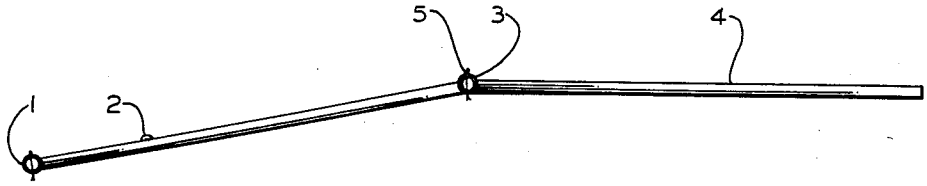
FIG. 2 is a side view of one of the yoke-like members or handles.

The handles or members will be described with reference to FIGS. 1 and 2. It is to be understood that the handles are identical and thus reference to only one is needed. The yoke-like member includes five rods. A canoe cross rod or first rod 1 is a one inch tube that is preferably twelve inches long and has holes at each end and has a hole at its center. An elongated connecting rod or second rod 2 is attached to the first rod 1 at the center hole. The second rod 2 is a one inch tube that is perferably twenty-four inches long with one-quarter inch holes at each end. A quick release pin 5 is inserted with respect to rods 1 and 2. The other end of rod 2 is connected to a third rod or cross rod 3 at its mid-point by another pin 5. Rod 3 is perferably a one and one-half inch tube twelve inches long with one inch holes at each end. Finally, shoulder engaging rods or fourth and fifth rods 4 are connected to each end of the rod 3 by pins 5. Rods 4 are parallel to each other and preferably one inch tubes twenty-four inches long. All the rods may be constructed from a light-weight material, such as aluminum.

The assembly of the device is such that the smaller diameter rods 2 and 4 are inserted into the larger diameter rods 1 and 3 and held together by quick-release locking pins 5. As seen in FIGS. 2 and 4, the orientation of holes in rods 2, 3, and 4 in such that the connection of rods 2 and 4 to rod 3 forms an angled member. The angle facilitates the portage of the device so that rods 4 may be horizontal. The connection to the canoe and portage will be described hereinafter.

To connect the assembled yoke-like member to a canoe, the rod 1 is placed across the canoe proximate an end (see FIG. 3). The handles or yoke-like member are attached to be canoe by a segment of rope 7. The rope is attached to the canoe by an appropriate means and are tied around rod 2 of the handles.

To lift the canoe, two persons get at opposite ends of the boat. They lift up on the handles and position rods 4 on their shoulders. With reference to FIG. 4, it can be seen that the upward force applied allows rod 1 to remain on the boat while a substantial part of the lifting force is transmitted through the ropes 7 to raise the canoe 6. The dimensions of the rods may be any suitably connecting equivalents. Similarly, the rods may be formed from any suitable material, not only aluminum. Also, the handles could be made directly on the canoe with the ability to swing out from the ends of the canoe.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention as claimed.

Having described the invention, I claim:

1. A device for the portage of a canoe where the canoe will remain in an upright position, comprising a pair of yoke-like members attachable to opposite ends of said canoe, each yoke-like member comprising five rods attached to each other, the rods include two parallel shoulder engaging rods, a cross rod, an elongated connecting rod, and a canoe cross rod, where the canoe cross rod has a center hole for acceptance of one end of the elongated connecting rod, the cross rod has a center hole which accepts the other end of the elongated connecting rod, the cross rod further having, on the opposite side of its perimeter from the center hole; end holes, one proximate each end which each accept an end of each respective shoulder engaging rods, connecting pins are provided at each point of intersection and attachment of the rods to maintain these rods together; whereby in use, the yoke-like members are connected to the canoe by a rope attached to the canoe, so that canoe cross rod is secured across an end of said canoe and when the shoulder engaging rods are rested on the shoulders of the persons carrying the device, the canoe remains stable and upright so that it is possible to carry cargo in said canoe.

* * * * *